US012179127B2

(12) United States Patent
Kronberger et al.

(10) Patent No.: US 12,179,127 B2
(45) Date of Patent: Dec. 31, 2024

(54) TOY WITH INTEGRATED LIGHT PIPES

(71) Applicant: The Marketing Store Worldwide, L.P., Chicago, IL (US)

(72) Inventors: Warren Kronberger, Minooka, IL (US); Francis Ng, Hong Kong (CN); Tom Brosseau, Schaumburg, IL (US); Steve Novak, Woodridge, IL (US)

(73) Assignee: The Marketing Store Worldwide, L.P., Chicago, IL (US)

( * ) Notice: Subject to any disclaimer, the term of this patent is extended or adjusted under 35 U.S.C. 154(b) by 175 days.

(21) Appl. No.: 17/764,383

(22) PCT Filed: Sep. 28, 2020

(86) PCT No.: PCT/US2020/053121

§ 371 (c)(1),
(2) Date: Mar. 28, 2022

(87) PCT Pub. No.: WO2021/062386

PCT Pub. Date: Apr. 1, 2021

(65) Prior Publication Data

US 2022/0288503 A1 Sep. 15, 2022

Related U.S. Application Data

(60) Provisional application No. 62/907,067, filed on Sep. 27, 2019.

(51) Int. Cl.

| | |
|---|---|
| ***A63H 33/22*** | (2006.01) |
| ***A63H 3/00*** | (2006.01) |
| *A63H 3/38* | (2006.01) |

(52) U.S. Cl.
CPC ..... *A63H 33/22* (2013.01); *A63H 3/006* (2013.01); *A63H 3/38* (2013.01)

(58) Field of Classification Search
CPC . A63H 3/006; A63H 3/36; A63H 3/38; A63H 33/00; A63H 33/22; A63H 33/26
(Continued)

(56) References Cited

U.S. PATENT DOCUMENTS 2,432,632 A * 12/1947 Seibel ..... F21S 6/002 362/567
2,883,796 A * 4/1959 Reveka ..... A63H 19/20 362/511

(Continued)

FOREIGN PATENT DOCUMENTS

| | | |
|---|---|---|
| DE | 4302572 A1 | 8/1994 |
| EP | 2827589 A1 | 1/2015 |

OTHER PUBLICATIONS

European Search Report dated Sep. 27, 2023 for EP Patent Application No. 20868668.3.

(Continued)

*Primary Examiner* — Alexander R Niconovich
(74) *Attorney, Agent, or Firm* — Reed Smith LLP; Matthew P. Frederick

(57) ABSTRACT

Devices and methods for illuminating an interactive toy via a light pipe and an external light source. The toy may include a housing. The housing may include a collector portion and at least one output portion. The toy may not have any internal battery, light, or electronics. The light source may be provided via a mount for the toy, such as an electronic device.

30 Claims, 10 Drawing Sheets

(58) Field of Classification Search
USPC ..... 446/118, 219, 485; 362/551, 565
See application file for complete search history.

(56) References Cited

U.S. PATENT DOCUMENTS 3,181,271 A * 5/1965 Withams ..... A63H 33/22 446/219
3,589,056 A * 6/1971 Glass ..... A63H 33/108 385/88
3,624,385 A * 11/1971 Wall ..... G02B 6/4298 385/115
3,634,678 A * 1/1972 Glass ..... G02B 6/0001 D26/127
3,684,882 A * 8/1972 Mininno ..... F21S 9/02 362/184
4,097,917 A * 6/1978 McCaslin ..... G02B 6/0005 446/175
4,521,205 A * 6/1985 Spector ..... A63H 3/006 360/79
4,630,177 A * 12/1986 Von Kohorn ..... B44C 5/00 362/311.15
4,655,721 A * 4/1987 Loomis ..... A63H 17/28 446/392
4,729,069 A * 3/1988 Von Kohorn ..... G02B 6/0001 362/805
4,828,527 A * 5/1989 Spector ..... A63H 3/28 446/302
4,891,030 A * 1/1990 Gertzfeld ..... A63F 9/10 446/124
5,324,224 A * 6/1994 Anderson ..... A63H 33/26 362/184
5,391,105 A * 2/1995 Jones ..... A63H 33/22 446/485
5,573,017 A * 11/1996 Post ..... A44C 15/0015 132/275
5,619,182 A * 4/1997 Robb ..... A63H 33/22 340/815.45
5,727,577 A * 3/1998 Post ..... A44C 15/0015 132/275
5,876,262 A * 3/1999 Kelly ..... A63H 33/22 108/23
6,012,820 A * 1/2000 Weber ..... A63B 15/02 446/485
6,082,876 A * 7/2000 Hanson ..... F21V 9/45 362/186
6,238,261 B1 * 5/2001 Lang ..... A63H 33/22 446/485
6,641,280 B2 * 11/2003 Hanson ..... F21V 33/0084 362/186
6,645,038 B2 * 11/2003 Trotto ..... A63H 33/22 446/485
6,729,932 B2 * 5/2004 Jarvis ..... A63H 33/22 40/547
7,654,023 B2 * 2/2010 Peters ..... G09F 9/305 40/564
7,726,830 B2 * 6/2010 Yang ..... B44C 5/005 362/101
7,988,525 B2 * 8/2011 Garbos ..... A63H 33/22 446/485
8,864,354 B2 * 10/2014 Lorati ..... F21V 33/0004 362/565
9,242,185 B2 * 1/2016 Silver ..... A63H 3/14
9,636,594 B2 * 5/2017 Rehkemper ..... A63H 3/38
9,874,340 B2 * 1/2018 Chien ..... F21V 33/0056
10,661,851 B2 * 5/2020 Ebel ..... B62J 11/19
10,738,972 B1 * 8/2020 Kelly ..... F21V 23/0414
2002/0141200 A1 * 10/2002 Pan ..... A41G 1/005 362/551
2012/0268924 A1 * 10/2012 Whang ..... A63F 9/0613 362/184
2014/0160784 A1 * 6/2014 Badahdah ..... H01L 31/02325 362/558
2015/0072589 A1 * 3/2015 Chan ..... A63H 3/006 446/219
2016/0018083 A1 * 1/2016 Kelly ..... A63H 33/22 362/372
2017/0021884 A1 1/2017 Ebel
2019/0060777 A1 * 2/2019 Kelly ..... F21V 33/008
2021/0299587 A1 * 9/2021 Brennecke ..... A63H 33/22

OTHER PUBLICATIONS

Willis et al., "Printed Optics: 3D Printing of Embedded Optical Elements for Interactive Devices", doi:10.1145/2380116.2380190, (20120000), URL: http://www.kevinli.net/courses/mobilehci_w2014/papers/printedoptics.pdf, XP055094118 [X] 1-16, 18-20, entire document, especially Figs 1-19 [Y] 17.
International Search Report for PCT/US2020/053121, dated Mar. 1, 2021.
GenCon 2011—Electronic Gaming Table, Aug. 12, 2011 (Aug. 12, 2011), XP054981830, Retrieved from the Internet <URL:https://www.youtube.com/watch?v=6xWLvcRFBQI>.
Willis et al.: "Printed Optics: 3D Printing of Embedded Optical Elements for Interactive Devices", 2012, XP055094118, Retrieved from the Internet <URL:http://www.kevinli.net/courses/mobilehci_w2014/papers/printedoptics.pdf> DOI: 10.1145/2380116.2380190.

* cited by examiner

TOY WITH INTEGRATED LIGHT PIPES

CROSS-REFERENCE TO RELATED APPLICATION

This is a 371 of International Patent Application No. PCT/US2020/053121 filed on Sep. 28, 2020 and claims the benefit under 35 U.S.C. § 119(e) of the earlier filing date of U.S. Provisional Patent Application No. 62/907,067 filed on Sep. 27, 2019, the disclosure of each are incorporated by reference herein.

FIELD OF THE INVENTION

The present invention is directed to illuminable and interactive toys.

BACKGROUND OF THE INVENTION

A toy can depict one of various characters or objects that have defining features that are preferably illuminable or changeable in appearance.

SUMMARY OF THE INVENTION

In embodiments, a toy comprises a housing and a unitary thermoplastic light pipe mounted to the housing. The housing comprises a first exterior surface, a second exterior surface, and a feature at the second exterior surface. The light pipe comprises a collector portion proximate the first exterior surface of the housing, a transmitter portion, and an output portion proximate the feature of the housing. The surface area of the collector portion is greater than or equal to twice the surface area of the output portion. The light pipe is configured to transmit light incident on the first exterior surface of the housing to the output portion, illuminating the feature of the housing. The light pipe provides a maximum angle of deflection of about 35-45 degrees.

In embodiments, the light pipe comprises at least one curve that is less than or equal to a maximum angle of deflection.

In embodiments, the maximum angle of deflection is about 41 degrees.

In embodiments, the light pipe is formed of PMMA.

In embodiments, the light pipe comprises two or more collector portions.

In embodiments, the light pipe comprises two or more output portions.

In embodiments, the light pipe is only attached to the housing at one or both of the collector portion and the output portion.

In embodiments, the collector portion is a truncated conical shape.

A feature and benefit of embodiments is the collector portion provided in a portion of a base of the toy.

A feature and benefit of embodiments is the output portion mounted in one or more of a head, eyes, hands, clothing, and weapon or accessory of the toy.

A feature and benefit of embodiments is the toy does not comprise the light source.

In other embodiments a toy system comprises a mount, a light source, and a toy. The toy comprises a base sized to support the toy on the mount, a housing comprising a first exterior surface, a second exterior surface, and a feature at the second exterior surface, and a light pipe mounted to the housing. The light pipe comprises a collector portion proximate a first exterior surface of the housing, a transmitter portion, and an output portion proximate the feature of the housing. The light pipe is configured to transmit light from the light source to the output portion, illuminating the feature of the housing.

In embodiments, the light pipe comprises at least one curve that is less than or equal to a maximum angle of deflection, wherein the maximum angle of deflection is about 35-45 degrees.

In embodiments, the mount comprises a predetermined placement area for the base of the toy, wherein the light source is configured to illuminate a portion of the base of the toy when the base of the toy is located in the placement area of the mount.

In embodiments, the mount comprises two or more predetermined placement areas corresponding to two or more toys having different features.

A feature and benefit of embodiments is the mount is an elevated platform configured to allow ambient light to reach the base of the toy when the toy is on the elevated platform, wherein the light pipe is configured to transmit said ambient light from the base of the toy to the output portion of the light pipe.

In embodiments, the light source comprises a display of an electronic device, the display configured to show: an outline of a base of said toy defining a placement area, an illumination area corresponding to a collector portion of the light pipe, and an activation button.

In embodiments, an electronic device comprises the mount and the light source.

A feature and benefit of embodiments is the toy comprising two or more toys, the light source configured to output a different color light to each of the two or more toys.

A feature and benefit of embodiments is the toy comprising a first toy and a second toy having different features; the mount comprising a first placement area corresponding to the base of the first toy and a second placement area of the second toy; and the light source comprising a first light source corresponding to the first placement area of the mount and a second light source corresponding to the second placement area of the mount, wherein the first light source is configured to illuminate the collector portion of the light pipe at the base of the first toy and to not illuminate the collector portion of the light pipe at the base of the second toy, and wherein the second light source is configured to illuminate the collector portion at the base of the second toy and to not illuminate the collector portion at the base of the first toy.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1A:
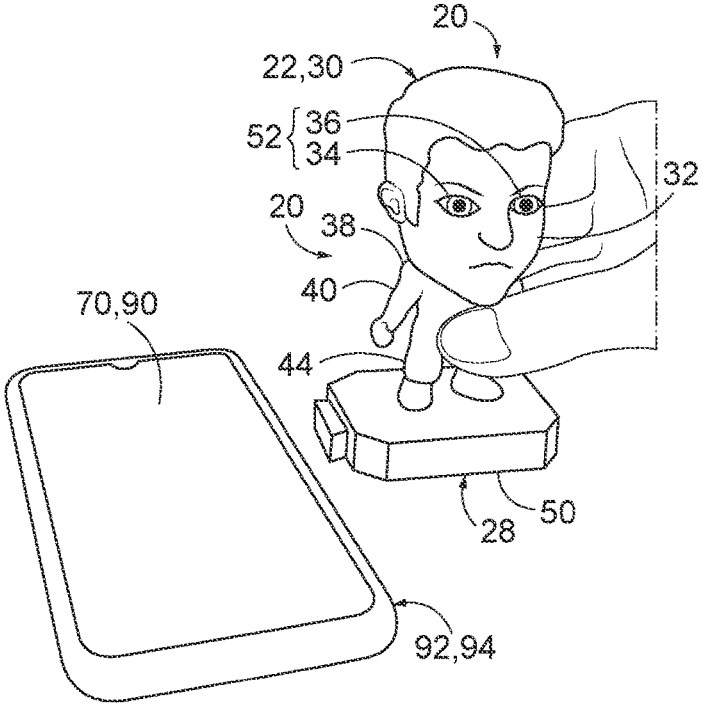
FIG. 1A is a front perspective view of an embodiment of a toy spaced from a light source being a mobile device in accordance with embodiments of the present disclosure.
Figure 1B:
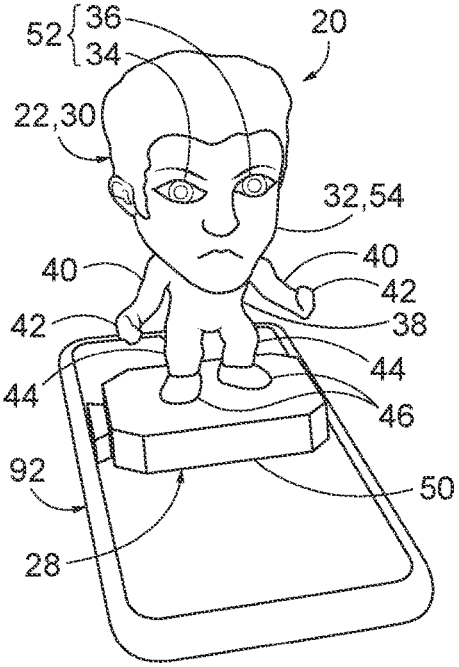
FIG. 1B is a front perspective view of the embodiment of FIG. 1A with the toy mounted on the light source showing interaction between the toy and the light source.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Toy and Toy Housing

FIGS. 1A through 3C show a toy 20 according to an exemplary embodiment of the invention. In this embodiment, the toy 20 is comprised of a housing 22 and one or more light pipes 24, 26. The housing 22 may have various forms and may be formed or mounted on a base 28. In this embodiment, the housing 22 is a humanoid character including a head 30 with a face 32, a first eye 34, a second eye 36, a body 38, arms 40 with hands 42, and legs 44 with feet 46.

The housing 22 and the light pipes 24, 26 are configured such that the light pipe 24 may use light from a light source 70 incident on one surface of the housing 22 and transmit the light through the light pipe 24 to another surface of the housing 22, such as an upper front surface 52 at the first and second eyes 34, 36 of the face 32. In one embodiment, the light pipes 24, 26 transmit light from a light source 70 incident on a bottom surface 50 of a base of the housing 22 through the interior of the housing 22 and to a feature 52 on another surface of the housing, for example, but not limited to, the feature 52 being the first and second eyes 34, 36 on an upper surface 54 of the housing 22 in the face 32. In comparing FIG. 1B to FIG. 1A, the eyes 34, 36 of the toy 20 are changed and illuminated when the toy 20 is properly placed relative to the light source 70.

In certain embodiments, the housing 22 and light pipes 24, 26 are formed by injection molding. However, other manufacturing methods may be used including three-dimensional printing or machining. For example, in some embodiments, the light pipes 24, 26 are coextensive with the other parts of the toy 20, i.e. the toy 20 is one solid continuous piece of material, with the light pipes 24, 26 comprising portions of the toy 20 that are able to transmit light. In other embodiments, the light pipes 24, 26 are coextensive with only a portion of the toy 20 or are formed separately from the toy 20.

Figure 3A:
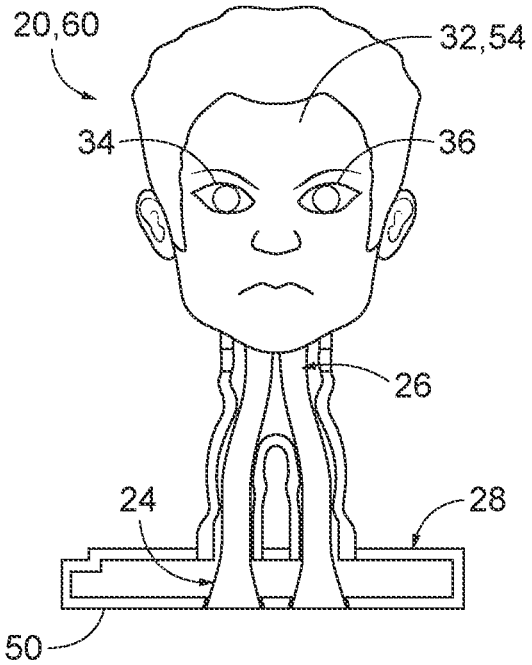
FIG. 3A is a front view of the toy of FIG. 1A with certain parts omitted.
Figure 3B:
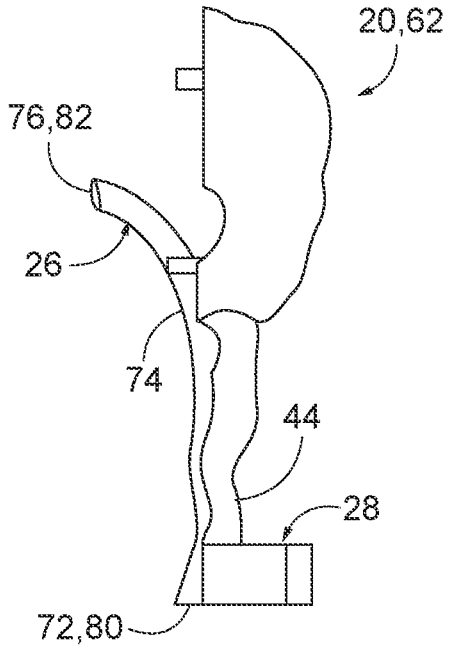
FIG. 3B is a side view of a rear portion of the toy of FIG. 1A.
Figure 3C:
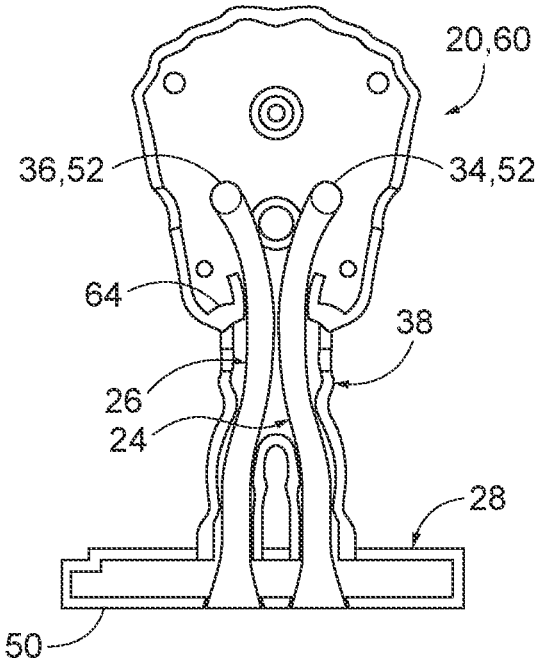
FIG. 3C is a rear view of a front portion of the toy of FIG. 1A.

The housing 22 may be comprised of one or more components assembled together. In one embodiment, the housing 22 is comprised of two components, a front component 60 (FIGS. 3A and 3C) and a rear component 62 (FIG. 3B). In a further embodiment, the components 60, 62 are formed by, for example, but not limited to, injection molding, casting, stamping, and rotational molding. In certain embodiments, the light pipes 24, 26 are coextensive with one of the front component 60 and the rear component 62 and may be formed as one solid continuous piece of material with the respective component.

Figure 4:
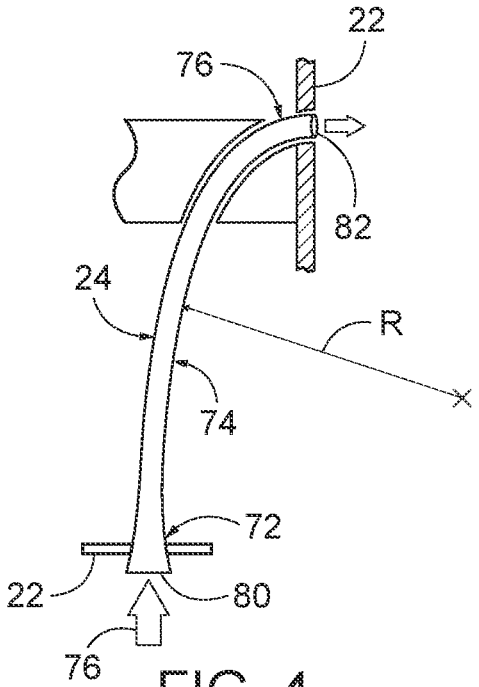
FIG. 4 is a side view of an embodiment of a light pipe applicable to embodiments of the present disclosure.

The housing 22 and the light pipes 24, 26 may be assembled by any known techniques including mechanical connections such as a snap fit or a pressure fit, or by use of adhesives, welding, rivets, screws, ribbing, or other fasteners. FIG. 4 shows an exemplary embodiment for how the light pipes 24, 26 may be secured to the housing 22 with a positive connection at the base 28, for example via press fit, adhesive, or the like. In one embodiment, the light pipes 24, 26 are secured to the housing 22 near one or both of the bottom surface 50 (or first exterior surface 50) and the upper surface 54 (or second exterior surface 54) of the housing 22, and any points of contact between the housing and the light pipes are at locations spaced apart from any curves or bends in the light pipes 24, 26. In another embodiment, ribs 64 or other internal structures (e.g., posts, flanges, and the like) in the housing 22 may be used to hold the light pipes 24, 26 in place. Such structures may be integrally formed with the housing 22, integrally formed with the light pipes 24, 26, and/or may be separate parts installed within the housing 22. In still further embodiments, the light pipe 24, 26 does not have any sharp edges or bends in order to facilitate being retained in the housing 22. In other embodiments, any features of the light pipe 24, 26 that interact with the housing 22 are proximate to the terminal ends of the light pipe 24, 26, at either a collector portion 72 and/or an output portion 76. In certain embodiments, the light pipe 24, 26 does not include any retention features that would otherwise assist in affixing the light pipe 24, 26 to the housing, 22. As used herein, examples of retention features include but are not limited to features whose purpose is other than to transmit light, such as bosses, ribs, struts, buttons, protrusions, ridges, grooves, recesses, shoulders, and the like. In further embodiments, the light pipe 24 is secured by the housing 22 in only one location on the light pipe 24. In other embodiments, the light pipe 24 is secured by the housing 22 in only two locations on the light pipe 24. In still further embodiments, the light pipe 24 is secured by the housing 22 in only three locations on the light pipe 24.

In certain embodiments, the toy 20 does not include any internal electronics or batteries. In other embodiments, the toy may include electronics and/or batteries (not shown) inside the toy 20 for any purpose, including additional or supplemental illumination. For instance, the electronics and/or batteries may be used for emitting sound from the toy 20 or actuating movement of the toy 20. The base 28 of the toy 20 may include features such as tabs 56 and slots 58 (FIG. 2) for connecting to additional toys, platforms, or other structures.

Figure 6:
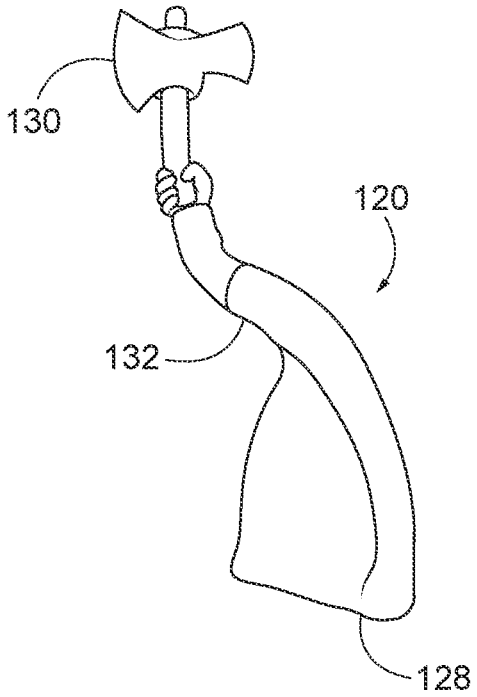
FIG. 6 is an embodiment of a light pipe incorporated into a portion of a toy in accordance with embodiments of the present disclosure.

As noted, many variations of the toy and the housing are contemplated and applicable to the present invention. In some embodiments, the housing 22 forms the shape of a humanoid figurine, an animal, a vehicle, a weapon, a building, or some other object or portion thereof. In other embodiment, the housing 22 forms a geometric shape. In some embodiments, a toy 120 (FIGS. 6-7) is embodied as a weapon 130 and an arm 132 of a character extending from a base 128. Additional example embodiments of humanoid characters with varying appearances, features, and light pipe arrangements are shown as toys 170 (FIG. 8), 220 (FIG. 9), 320 (FIGS. 11A-11E), 420 (FIGS. 12A-13C), 520 (FIGS. 14-16), and 620 with 720 and 820 (FIG. 17B). Details and variations of the toy 20 discussed herein are applicable to any of the toy embodiments. These various toys may be implemented with any of the mounts and light sources disclosed herein. In general, the toy 20, 120, 170, 220, 320, 420, 520, 620, 720, 820 is configured to interact with the light source 70 to illuminate a feature of the toy, thereby expanding the utility and play possibilities. For example, the illuminated feature(s) may represent supernatural or magical powers of a fictional character depicted by the toy.

Light Pipe

Figure 5:
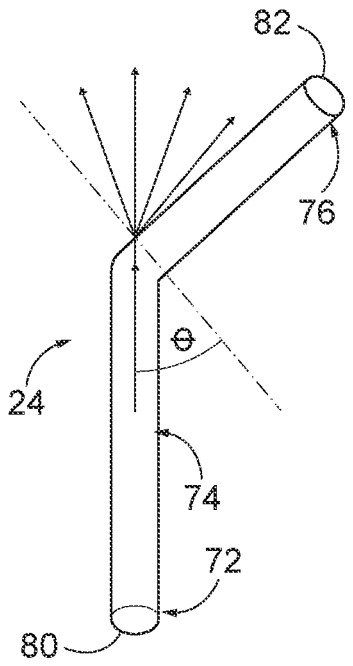
FIG. 5 is a side schematic view of an embodiment of a light pipe applicable to embodiments of the present disclosure.

One embodiment of light pipe 24 is shown isolated in FIG. 4 and schematically in FIG. 5, the features of the light pipe 24 being generally applicable to any disclosed embodiments of light pipes for toys disclosed herein. In certain embodiments, the light pipe 24 transmits light from a light source 70 incident on the bottom of the base 28 of the housing 22 to the features 52 on an upper portion of the housing 22.

In certain embodiments, each light pipe 24 comprises a collector portion 72, a transmitter portion 74, and an output portion 76. The collector portion 72, transmitter portion 74, and output portion 76 work together such that light incident on the collector portion 72 may be transmitted through the light pipe 24 to the output portion 76 with minimal loss of light from the light pipe 24 in between the collector and output portions. In certain embodiments, the outer surface of light pipe 24 is smooth.

In certain embodiments, the light pipe 24 is comprised of a thermoplastic such as poly (methyl methacrylate), or PMMA. In other embodiments, the light pipe 24 is made from a material selected from the group consisting of glass, crystal, acrylics, PMMA, PVC, ABS, polycarbonate, cycloolefin copolymers, PMMI, and silicones. Various other materials and arrangements are contemplated. For example, the light pipe 24 may be comprised of a transparent or clear material, while in other embodiments, the light pipe is comprised of a material that is able to transmit light and is tinted or colored. In another embodiment, the light pipe 24 and each portion thereof comprises a solid unitary piece of material. In still another embodiment, each portion of the light pipe 24 is made from separate pieces of material, which may have their own properties. The light pipe 24 or portions thereof may be supplemented with internal voids or channels or roughened or otherwise modified surfaces.

In one embodiment, the light pipe 24 is surrounded by air in the interior of the housing 22, in other words, the light pipe 24 is only held within the housing 22 at its ends. In another embodiment, the light pipe 24 is surrounded in a cladding material such as an opaque material. In still further embodiments, the light pipe 24 is integral to and coextensive with the housing.

In certain embodiments, the light pipe 24 is calibrated to transmit light in view of its material, shape, and other properties. In some embodiments, the light pipe 24 comprises one continuous piece and is designed with only smooth internal and external surfaces and gradual curves while avoiding sharp edges and sharp bends. For example, a portion or a majority of the light pipe 24 may have a consistent curve defined by a large radius R (FIG. 4). In one embodiment, the maximum bend angle of any curve in the light pipe 24 is less than or equal to the critical angle $\theta_{crit}$ for total internal reflection (TIR). The critical angle for TIR may be calculated using a derivative of Snell's law: $\theta_{crit}=\arcsin(n_2/n_1)$, where $\theta_{crit}$ is the critical angle, $n_1$ is the refractive index of the material of the light pipe (for plastics, $n_1$ can range from about 1.3 to 1.75 and for PMIVIA is about 1.49), and $n_2$ is the refractive index of the cladding material surrounding the light pipe such as air (for air, $n_2=1$). In addition, other factors such as surface roughness or manufacturing processes may impact the ability of the light pipe 24 to efficiently transmit light to the output portion 76. In certain embodiments, the maximum angle of any curve in the light pipes is less than or equal to the critical angle for TIR with a design margin to account for surface roughness or other factors. In one embodiment, the design margin is less than 5%. In another embodiment, the design margin is between 5% and 10%. In a further embodiments, the design margin is between 6% and 8%. In one embodiment, the light pipe is made from PMMA and the maximum bend angle is around 44 degrees corresponding to the critical angle for total internal reflection. In another embodiment, the light pipe is made from PMMA and the maximum angle of any curves in the light pipes is less than 41 degrees corresponding to the critical angle for total internal reflection with an approximately 7% design margin.

Collector

In one embodiment, the collector portion 72 includes a collection surface 80 and a condenser or collimator (not shown) or other such optical lenses for capturing and/or manipulating light. The collection surface 80 comprises a two-dimensional surface with a corresponding surface area. The collection surface 80 is configured to capture or transmit light from an external source such as a diffuse light source 70 such as a smartphone or tablet screen, or even ambient light, and across the collection surface and into the light pipe 24. The collection surface 80 may take on many different shapes including a circular shape, an elliptical shape, a polygonal, or free form shape. In addition, the collection surface 80 may be flat, or a three dimension shape such as convex, concave, smooth, contoured, or include bends or other features. In one embodiment, the collection surface 80 comprises a flat, circular or elliptical two-dimensional shape.

The condenser or collimator is a lens that comprises one or more three-dimensional geometric shapes. The condenser is configured to transmit light from the collection surface to the transmitter portion. In certain embodiments, the condenser portion 72 changes shape from the larger surface area of the collection surface 80 to the smaller diameter of the transmitter portion 74. The condenser may take on many different shapes including a truncated polyhedron, cone, cylinder, sphere, or other geometric shape. In embodiments shown, for example, in FIGS. 3A, 3C, and 9, the collector portion 72 and the condenser comprise a truncated conical shape with the apex proximate to the transmitter portion 74.

The collector portion 72 and, in particular, the collection surface 80, may be located proximate to any portion of the toy housing 22. In one embodiment, the collector portion 72 is located within the base 28 and/or feet 46 of the toy 20 and the collection surface 80 is facing downward when the toy is positioned upright on its base 28. Other locations may include vertical surfaces of the base 28 or any area of the housing 30 of the toy 20.

Transmitter

In one embodiment, the transmitter portion 74 is connected to the collector portion 72 on one end and the output portion 76 on the other end. The transmitter portion 74 is configured to transmit light from the collector portion 72 to the output portion 76. In some embodiments, the transmitter portion 74 may include one or more optical lenses (not shown) for transmitting and/or manipulating light.

In certain embodiments, the transmitter portion 74 comprises one or more three-dimensional geometric shapes. The transmitter portion 74 may take on many different shapes including a polyhedron, cone, cylinder, sphere, or other geometric shape. In one embodiment, the transmitter portion 74 is generally tubular in shape. The transmitter portion 74 may be linear or fully or partially curved or bent. In one embodiment, the transmitter portion 74 comprises a cylinder or tube with a maximum bend angle as discussed above.

Output

In one embodiment, the output portion 76 is connected to the transmitter portion 74 and further comprises an output surface 82. In one embodiment, the output portion 76 corresponds to the feature 52 of the toy 20 to be illuminated such as the eyes 34, 36 of the toy, the details of the costume of the toy, or another accessory of the toy. In some embodiments, the output portion 76 may include one or more optical lenses (not shown) for emitting and/or manipulating light.

The output surface 82 comprises a surface with a corresponding surface area. The output surface 82 may take on many different shapes including a circular shape, an elliptical shape, or a polygonal shape. In addition, the output surface 82 may be flat or two dimensional, or may form a three-dimensional shape such as convex, concave, smooth, contoured, or include bends or other features. In one embodiment, the output surface 82 comprises a smooth surface without any bends or other features. Such a smooth surface allows for a more uniform light distribution across the output surface 82.

In certain embodiments, the output area does not include sharp interior corners or large interior shapes. In further embodiments, the surface area of the output portion 76 is not larger than the area of the cross-section of the transmitter portion 74. In still further embodiments, the surface area of the output portion 76 is not more than 10% larger than the area of the cross-section of the transmitter portion 74. In other embodiments, the surface area of the output portion 76 is not more than 20% larger than the area of the cross-section of the transmitter portion 74. In further embodiments, the surface area of the output portion 76 is not more than 50% larger than the area of the cross-section of the transmitter portion 74.

Correspondence Among Collector, Transmitter, and Output Portions

In one embodiment, the surface area of the collection surface 80 of the collector portion 72 has a size ratio compared to the surface area of a transverse cross-section of the transmitter portion 74. In other embodiments, the surface area of the collection surface 80 of the collector portion 72 has a size ratio compared to the surface area of the output surface 82 of the output portion 76. In some embodiments, the size ratio is about 2×, wherein, for example, the surface area of the collection surface 80 is about two times the size of the surface area of a transverse cross-section of the transmitter portion 74. In other embodiments, the size ratio is greater than about 2×. In other embodiments, the size ratio is in a range of from about 2× to 10×. In still other embodiments, the size ratio is about 7.5×. In the example shown in FIGS. 1-3 with a circular cross-section, the collection surface diameter is 11 millimeters (area of about 95 $mm^2$) whereas the output surface diameter is 4 mm (area of about 12.6 $mm^2$) resulting in a size ratio of approximately 7.5× (with a corresponding ratio of diameters being 2.75×).

Figure 7:
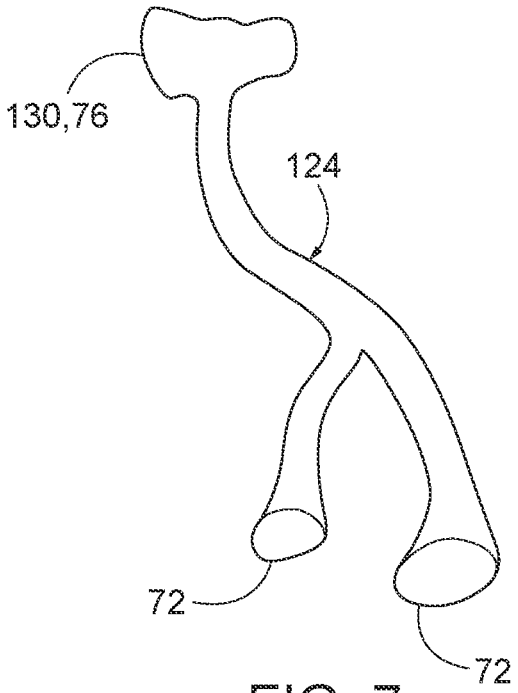
FIG. 7 is a perspective view of an embodiment of a light pipe comprising two separate collector portions converging into one transmitter portion at a weapon of the toy in accordance with embodiments of the present disclosure.
Figure 8:
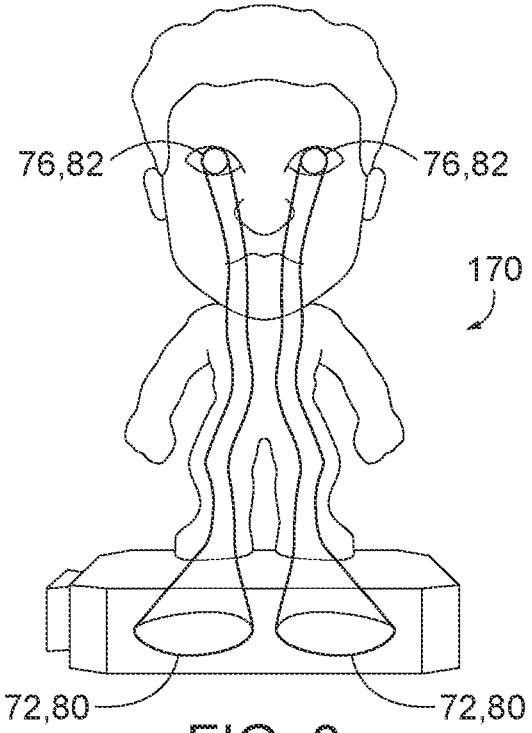
FIG. 8 is a front view of an embodiment of a toy comprising two separate light pipes in accordance with embodiments of the present disclosure.
Figure 9:
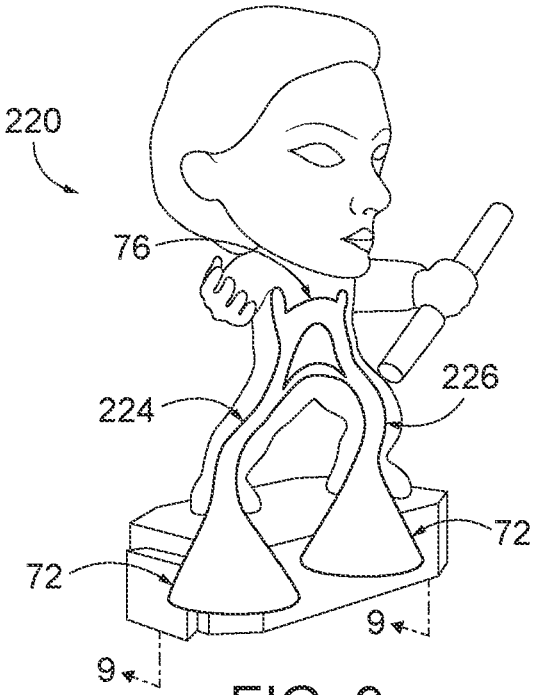
FIG. 9 is a front perspective view of an embodiment of a toy comprising a light pipe with two separate collector portions converging into one transmitter portion at the chest of the toy in accordance with embodiments of the present disclosure.
Figure 10:
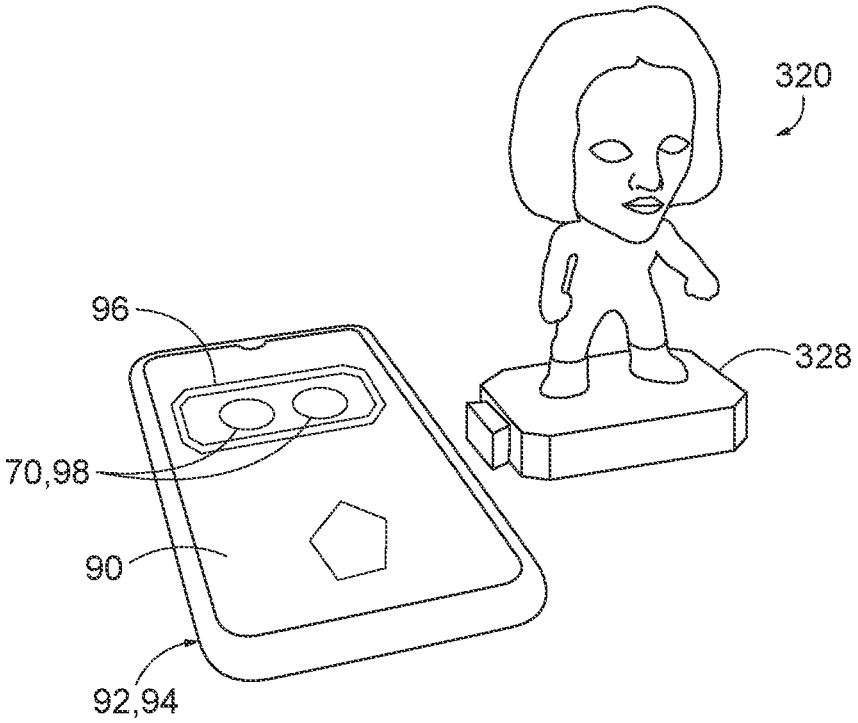
FIG. 10 is a front perspective view of the toy of FIG. 9 spaced from a light source being a mobile device in accordance with embodiments of the present disclosure.

In various embodiments, one or more collector portions 72 may be connected to one or more transmitter portions 74 and/or the one or more transmitter portions 74 may be further connected to one or more output portions 76. For instance, as shown in FIGS. 7 and 9, two collector portions 72 may be used to collect light for a single output portion 76. As another example, one collector portion 72 may be used to collect light for one or more output portions 76. As another example shown in FIGS. 9 and 11B, two transmitter portions 74 of light pipes 224, 226, 324, 326 may be connected to a single output portion 76. In some embodiments, one collector portion 72 is connected with only one transmitter portion 74 which is further connected with only one output portion 76, forming one discrete light pipe. In other embodiments shown in FIGS. 3A-3C and 12A-12B, a toy may comprise two or more discrete light pipes 24 with 26 and 424 with 426 with each collector portion 72 connected with only one transmitter portion 74 which is further connected with only one output portion 76.

Figure 14:
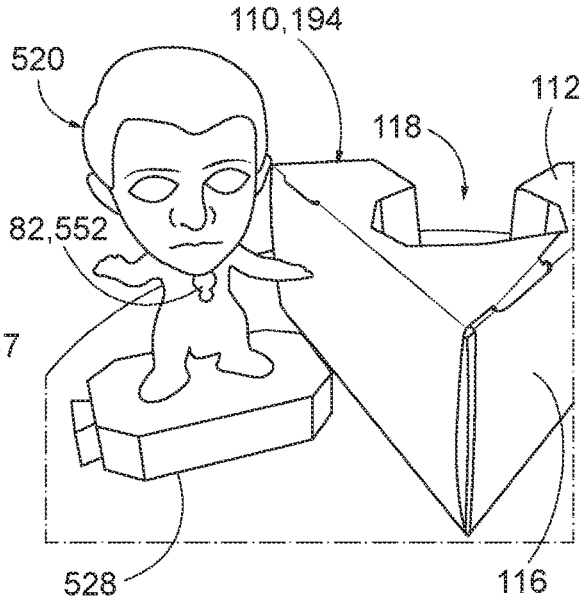
FIG. 14 is a front perspective view of an embodiment of a toy spaced from a platform light source for providing ambient light to a base of the toy in accordance with embodiments of the present disclosure.
Figure 15:
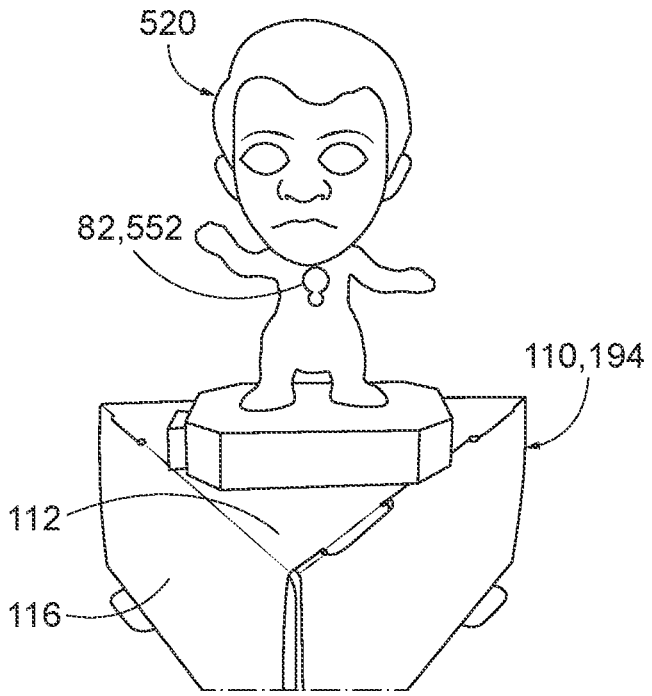
FIG. 15 is a front perspective view of the toy and platform of FIG. 14 with the toy mounted on the platform showing illumination of a feature of the toy.
Figure 16:
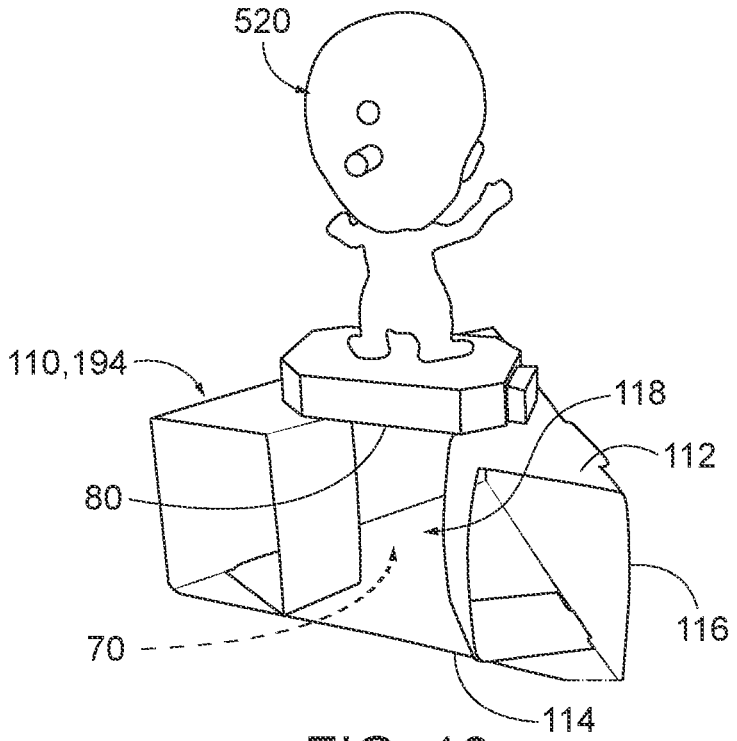
FIG. 16 is a rear perspective view of the toy and platform of FIG. 14.

In one embodiment, the design of the collector portion 72, transmitter portion 74, and output portion 76 as described in certain embodiments herein are unexpectedly effective at transmitting light incident on the collection surface 80 to the output surface 82. In one embodiment, the design of the collector, transmitter, and output portions is such that ambient light incident on the collection surface 80 is clearly visible at the output portion 76 and stands out even in ambient light such as shown in FIGS. 14 through 16. In such embodiments, light is clearly visible at the output surface 82 with ambient light only, and without an electric light source such as a device display, flashlight, or other portable light source. The ambient light comprising this light source 70 may emanate from e.g. light fixtures in a room, or from ambient outdoor light from the sun or moon.

Toy System

Figure 2:
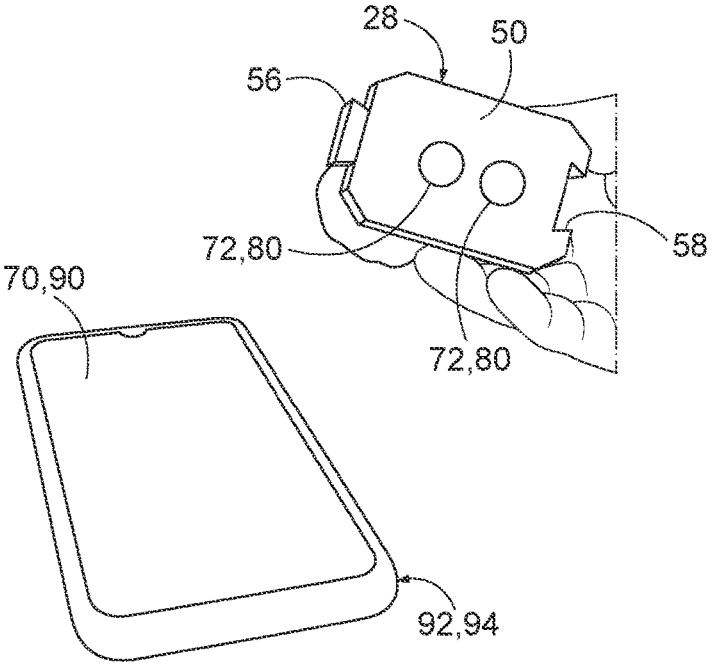
FIG. 2 is a bottom perspective view of the toy according to the embodiment of FIG. 1A.

FIGS. 1-3 show one exemplary toy 20, mount 94, and light source 70 according to an embodiment of the invention that together comprise a toy system. According to one embodiment, this interactive toy system is comprised of a toy 20 and an electronic device 92 (e.g., smartphone, tablet, or the like) that comprises both the mount 94 and the light source 70. The light source 70 may alternatively be provided by a separate light, a reflective surface, ambient light, as discussed in detail below. Various other mounts may be utilized, including a foldable cardboard mount 194 shown in FIGS. 14-16 or a relatively flat platform mount 294 shown in FIGS. 17A-17B. Such a mount 194, 294 may be a separate accessory toy or may be packaged and sold with one or more corresponding toys 20, 120, 170, 220, 320, 420, 520, 620, 720, 820.

Light Illumination Source

The toy may be illuminated by any light source 70. In certain embodiments, the light illumination source 70 is a display 90 that is part of an electronic device 92 such as a smartphone or tablet having a screen that is generally operable in a horizontal condition. In other embodiments, the light source 70 is an artificial light source such as a flashlight, LED or a lamp. In other embodiments, the light source 70 is a surface such as a table, paper, mirror, or polished surface. In those embodiments, the toy 20 may be held at a certain distance away from the light source 70, and the light is reflected from the light source 70 and into the collector portion 72. In some embodiments, the light pipe 24 transmits an effective amount of illumination to the output portion 76 from such reflected light, or even ambient light when the collector portion 72 is facing a light source 70 at a distance, e.g. an artificial light source or the sun or moon.

In one embodiment, the toy 20 and collector portion 72 may be placed directly on a light source 70, allowing the light source 70 to also function as a mount 94 for the toy. In other embodiments, the toy 20 and collector portion 72 may be positioned in proximity from the light source 70. In any embodiment, the housing 22 and one or more light pipes 24, 26 are configured such that the light pipes 24, 26 may use light from the light source 70 incident on one surface of the housing 22 and transmit it through the one or more light pipes 24, 26 to another surface of the housing 22 as discussed herein.

Light Source and Mount—Electronic Device Display

In one embodiment, the electronic device 92 including the display 90 is programmed to emit light from the display 90. One skilled in the art will appreciate that the electronic device 92 comprises the requisite battery, memory, and computer-readable media to run a program applicable to the present disclosure. The light emitted by the display 90 may be any color, intensity, or brightness permitted by the display hardware and software. The light may further be emitted in any shape on the surface of the display 90. The light emitted by the display 90 may be constant in intensity or color, or the light may change, adjust, dim, shimmer, or shift color.

In one embodiment, the device 92 is programmed to emit multiple colors across the surface of the display 90, represented in FIGS. 12A-13C as patterns depicting colors C1-C9. The light source 70 provided on the display 90 corresponds with the collector portions 72 of one or more of the toys 20, 420. As a result, the particular color C1-C9 at the collector portion 72 on the display 90 is transmitted to the feature 52, 452. In particular, the toy 20 has eyes 34, 36 as illuminable features 52 that may exhibit different colors C8 and C9 in FIG. 13C or the same color C7 in FIGS. 13A-13B. Likewise, the toy 420 has first and second uniform areas 434, 436 as illuminable features 452 that may exhibit different colors C8 and C9 in FIGS. 13A and 13B or the same color C7 in FIG. 13C.

In another embodiment, the device 92 is programmed to emit light in certain shapes across the surface. In related embodiments, the collector portions 72 of different toys may have different arrangements, such that a given arrangement of the light source 70 will illuminate one toy but not another. In still other embodiments, the shapes corresponding to the collector portions 72 of the toys may emit the same color, or may emit different colors. In still further embodiments, the shapes corresponding to the collector portions 72 of the toys may emit light effects such as changing color, flashing, strobe effects, and changes in intensity.

Figure 11A:
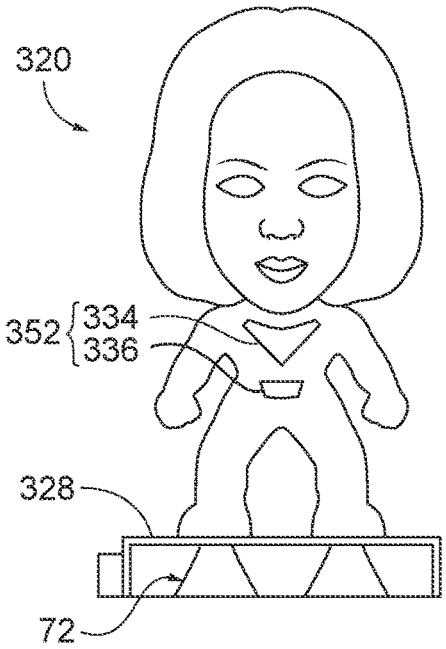
FIGS. 11A-11B are front views of the toy of FIG. 9 with a base shown in cross-section taken along the line 11-11 in FIG. 9.
Figure 11B:
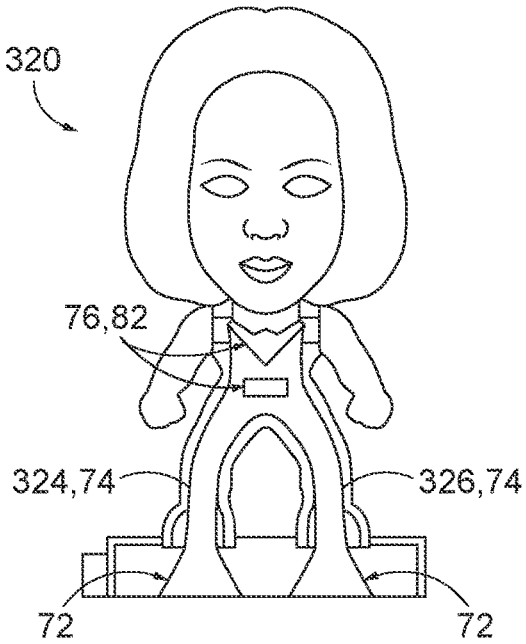
Figure 11C:
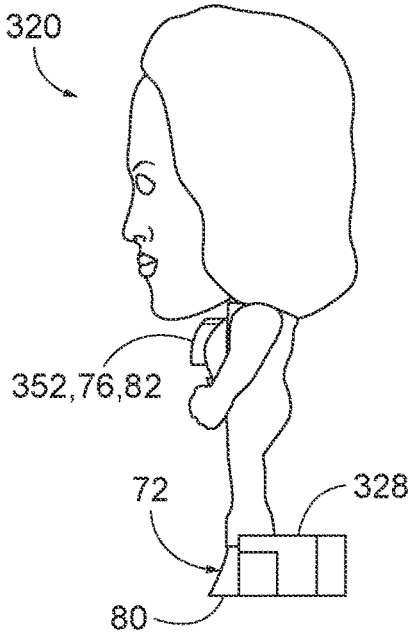
FIG. 11C is a side view of the toy of FIG. 9.
Figure 11D:
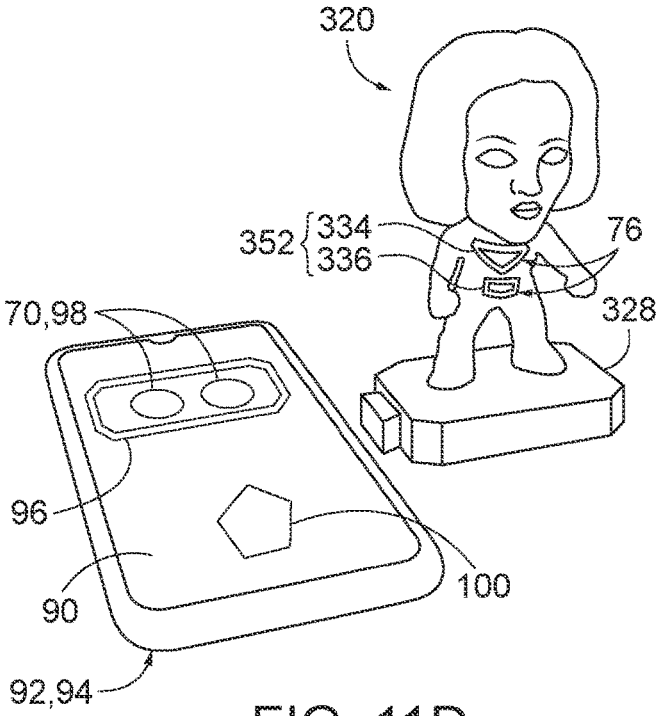
FIG. 11D is a front perspective view of the toy of FIG. 9 spaced from a light source being a mobile device in accordance with embodiments of the present disclosure.
Figure 11E:
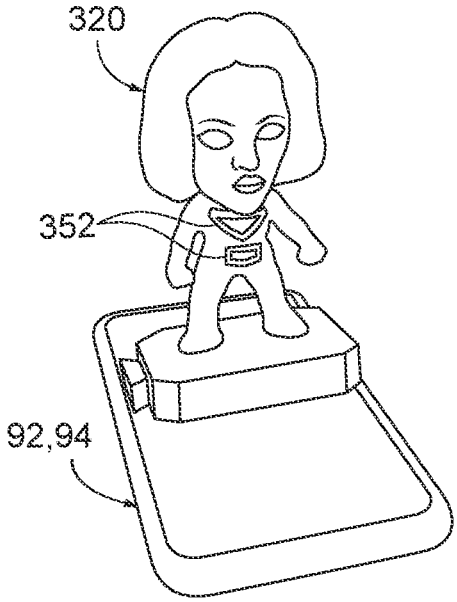
FIG. 11E is a front perspective view of the embodiment of FIG. 9 with the toy mounted on the light source showing interaction between the toy and the light source.
Figure 12A:
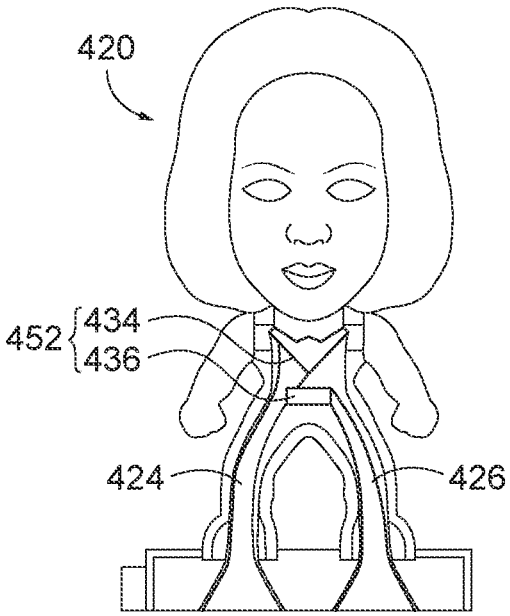
FIG. 12A is a front view of an embodiment of a toy comprising a light pipe with two separate collector portions and two separate transmitter portions at the chest of the toy in accordance with embodiments of the present disclosure.
Figure 12B:
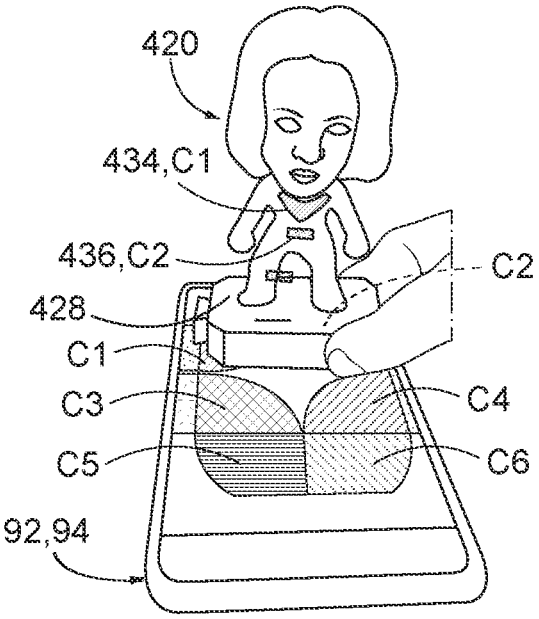
FIG. 12B is a front perspective view of the embodiment of FIG. 12A mounted on a light source being a mobile device with a varied display.
Figure 13A:
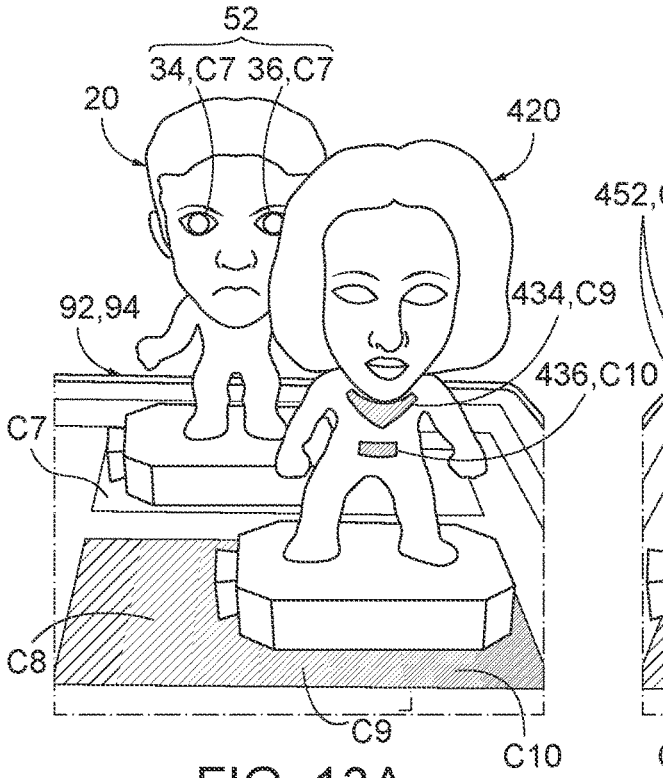
FIGS. 13A-13C are front perspective views of two embodiments of toys, the toy of FIG. 1A and the toy of FIG. 12A, mounted on a light source being a mobile device with a varied display showing interaction between the toys and the light source.
Figure 13B:
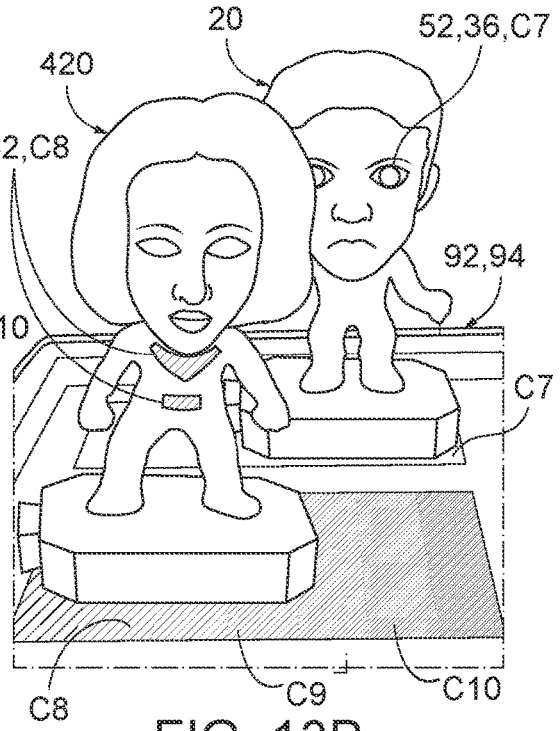
Figure 13C:
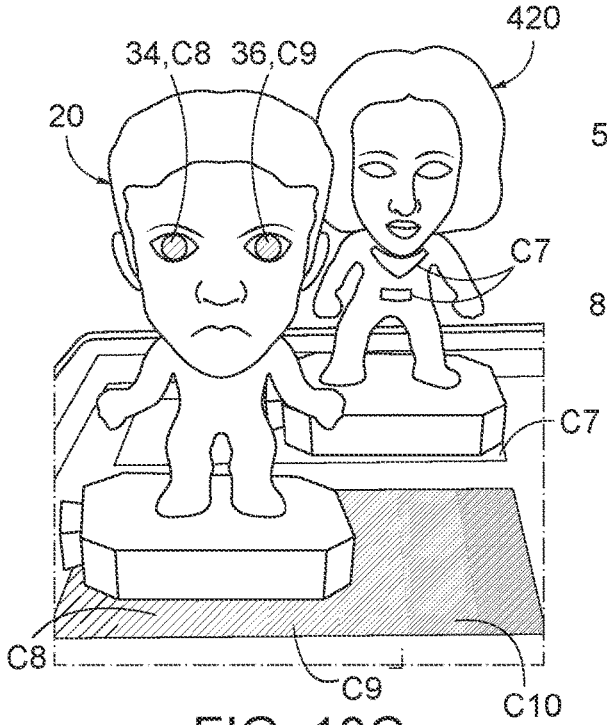

Referring to FIG. 11D, in some embodiments, the device 92 is programmed to display a placement area 96 constituting an outline of the base 28 of the toy 320 to allow a user to properly position the toy 320 on the display 90 surface. Within the placement area 96 are one or more illumination areas 98 to correspond with the collector portion(s) 72 of the toy and provide the light source 70. In one embodiment, the user may then press a virtual activation button 100 on the display 90, or a physical button (not shown) on the device 92, and the display 90 may subsequently emit light corresponding to the area of the collector portion 72 of the toy. In another embodiment, the display 90 may already be emitting light corresponding to the collector portion 72 of the toy 320 before the toy 320 is placed on the display 90. In either event, when the toy 320 is properly placed on the placement area 96 of the display 90 corresponding to the outline of the toy with the display emitting light in the illumination area 98 corresponding to the collector portion 72 of the toy, the light travels through the collector portion 72 to the transmitter portion 74 and then the output portion 76 of the light pipe 24 in the toy 320 may be illuminated. In other embodiments where a toy comprises two or more discrete light pipes 324, 326, the display 90 may emit either the same or different light effects at each illumination area 98 for each discrete light pipe.

The placement area 96 and the illumination area 98 providing the light source 70 may have various arrangements to have different effects on different toys applicable to the present disclosure. In some embodiments, the placement area 96 is an outline shape that is consistent for all applicable toys, a subset of applicable toys, or only one applicable toy. Moreover, the illumination area 98 corresponds to the collector portion 72 of one or more toys. Applicable toys may have respective collector portion(s) 72 in the same locations (e.g., in the same place at the bottom of the base 28 of the housing 22) or varied locations. Accordingly, illumination areas 98 may be provided that will illuminate all applicable toys, a subset of applicable toys, or only one applicable toy. As such, the light source 70 may illuminate the collector portion at the base of a first toy but not illuminate the collector portion at the base of a second toy.

In a further embodiment, the device 92 is programmed to emit an image on the display 90 corresponding to the area of the collector portion 72 of the toy 20, wherein the image is reproduced at the output portion 76 of the light pipe 24 in the toy 20. In other embodiments, the device 92 is programmed to output one or more sounds such as music, dialogue, and/or sound effects in conjunction with the light effects. In embodiments, the device 92 is programmed to emit one or more lights upon activation. In other embodiments, the device 92 is programmed to choreograph or coordinate the sounds and emitted light such as for a light show or to illustrate a story or a scene including the toy 20.

In some embodiments, the device 92 may be programmed to illustrate and narrate a story or scene. For instance, the device 92 may prompt the user to place one or more toys 320 on one or more portions of the display 90 and press an activation button 100 (such button may also be part of a touchscreen interface of the device display 90 as shown in FIG. 11D). Upon pressing of the activation button 100, the device 92 may output sounds and lights corresponding to a scene, where the light is transmitted through the toy 320 via the light pipes 324, 326 to create light effects on the toy 320. When the scene is complete, the device 92 may prompt the user to adjust the one or more toys 320 on the display or place different toys on the display and press the activation button 100. Upon pressing the activation button 100, the device 92 may output sounds and lights corresponding to a different scene.

In another embodiment, the device 92 is programmed to allow the user to program their own light and/or sound output according to user preference. In embodiments, the device 92 may be programmed with pre-existing options for light and/or sound output which may be adjusted according to user preference. In certain embodiments, the device 92 may be configured to sense a toy 320 or its position on or in proximity to a display 90 including, for instance, by using the capacitive touch capabilities of a device 92.

Light Source and Mount—Platform

Referring to embodiments shown in FIGS. 14-17B, both the mount 194, 294 and the light illumination source 70 may be provided by a platform 110 or 210. The platform 110, 210 is a separate structure from the toy(s) and may take any shape including a circular shape, an elliptical shape, a polygonal, or free form shape. In some embodiments, the platform 110, 210 may take the shape of a scene setting such as a spaceship, building, cityscape, or the like. The platform 110, 210 may be made out of cardboard as one unitary folded piece, from multiple cardboard parts, or may be made from paper, plastic and/or other materials.

In the embodiment of FIGS. 14-16, the platform 110 may include an upper portion 112, a lower portion 114, and one or more vertical portions 116. In an alternative embodiment, the platform 110 may only include an upper portion 112 and one or more vertical portions 116. The vertical portions 116 may be used to support the upper portion 112 of the platform 110. In other embodiments, vertical portions 116 may cover one or more sides of the platform 110.

In some embodiments, the upper portion 112 may be used to support one or more toys 520. In another embodiment, the upper portion 112 may have one or more lighting areas 118 formed as an opening or cutaway which allows a light source 70 to shine onto the collection surface(s) 72 of the toy 520. The upper portion 112 may include an outline (not shown) of the base 528 of the toy 520 as a placement area to show a user how to position the toy 520 on the upper portion 112, similar to the placement area 96 shown in FIG. 11D. In another embodiment, the upper portion 112 may include one or more docking areas (not shown) meant to positively secure the base 528 in place over the lighting area 118.

Figure 17A:
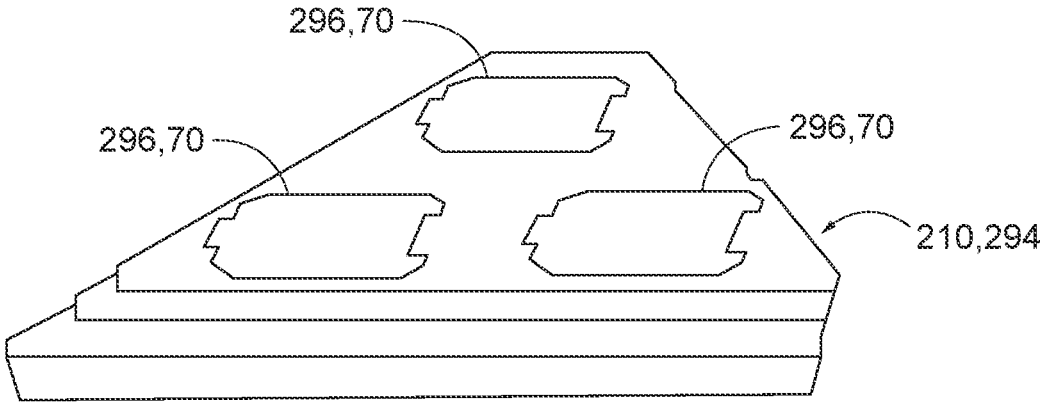
FIG. 17A is a front perspective view of an embodiment of a multi-toy platform in accordance with embodiments of the present disclosure.
Figure 17B:
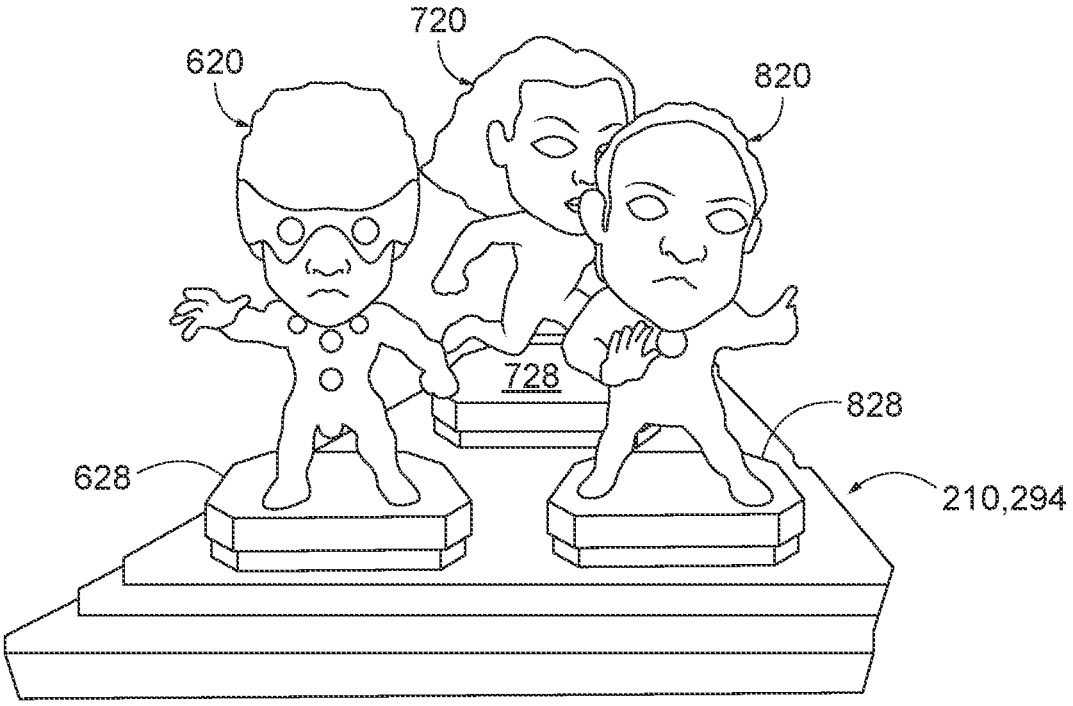
FIG. 17B a front perspective view of three toys mounted on the multi-toy platform of FIG. 17A.

Referring to FIGS. 17A-17B, in certain embodiments, the platform 210 provides a platform with an embedded light source 70 and three toys 620, 720, 820 that may interact with the platform 210. The platform 210 may include a power source such as a battery, an electric light source for the lighting area, sound source such as speakers, and/or other electronics. Such a platform 110, 210 may include an embedded light source 70 such as an LED for illuminating the lighting area and the light pipe features of the toys. In a further embodiment, the platform 110, 210 may be interactive. In embodiments, the platform may include an outline of the base of the toy 520 and/or a docking area meant to positively secure the base of the toy in place over the lighting area. In another embodiment, the docking area may include a trigger (not shown) for initiating electronics in the platform when the base of the toy is secured in the docking area. The trigger may include a physical switch, electronic sensor, or other switching mechanism. In other embodiments, the electronics in the platform 110, 210 may be operated by a button on the platform. In further embodiments, the electronics in the platform 110, 210 may be operated by a remote control such as by a smartphone or tablet communicating wirelessly with the platform. In certain embodiments, activating the trigger or button may cause the platform 110, 210 to emit light (e.g. incident to the base of the toys) and/or sound.

In another embodiment, the platform 110 does not include any power source, electronic light source for the lighting areas, or other electronics. In this embodiment shown in FIGS. 14-16, ambient light or light from a separate light source such as a flashlight or display may illuminate the lighting area 118. The lighting area 118 comprises an open area of the platform 110, formed in at least the upper portion 112 of the platform 110, which allows light from the separate light source to shine on a collection surface 80 of the toy 520 when placed over the lighting area 118.

In a further embodiment, the lower portion 114 of the platform 110 may be used to help reflect light to the upper portion 112 and, in particular, to the lighting area(s) 118. In embodiments without a lower portion, the platform 110 may be positioned on a separate surface such as a table and the table may help reflect light to the lighting area 118. In other embodiments, the platform 110 may be held and the light may reach the upper portion 112 without reflection. In another embodiment, the platform 110 includes its own light pipe (not shown) to transmit light from a first surface of the platform 110 to a lighting area of the platform and to the collection surface 80 of the toy 520. In certain of these embodiments, the toy 520 is positioned in such a way such that light is reflected into the collection surface 80 of the toy. The light source 70 may be ambient light as described herein, or the light may be from an indirect electric light source such as a flashlight, device display or some other portable electric light.

It will be appreciated that the present disclosure provides toys with unique functionality and even a digital interactive experience from a relatively low-cost and simplified design. Embodiments of the toy provide passively illuminated features such as eyes or other components of the toy without the need for electronics or batteries inside the toy. The disclosed toy and toy system provide a user an experience combining a physical toy and a digital experience through software on a separate electronic device, which digital experience can include visual animated effects and/or audio effects. Various light sources may be utilized to illuminate features of the toy, including a smartphone, tablet, LED, ambient light, or other sources such as reflection from bright colored table surfaces or light colored paper. One or more toys and one or more mounts may be combined together as a toy system with greater variety in play.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent embodiments of the invention and are therefore representative of the subject matter which is broadly contemplated by the present invention. It is further understood that the scope of the present invention fully encompasses other embodiments and that the scope of the present invention is accordingly limited by nothing other than the appended claims.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A toy comprising:

a housing comprising a first exterior surface, a second exterior surface, and a feature at the second exterior surface; and a unitary thermoplastic light pipe mounted to the housing and comprising:

a collector portion comprising a surface area proximate the first exterior surface of the housing, a transmitter portion, and an output portion comprising a surface area proximate the feature of the housing, wherein the surface area of the collector portion is greater than or equal to twice the surface area of the output portion, the unitary thermoplastic light pipe configured to transmit light incident on the first exterior surface of the housing to the output portion, illuminating the feature of the housing, wherein the unitary thermoplastic light pipe provides a maximum angle of deflection of about 35-45 degrees.

2. The toy of claim 1, the unitary thermoplastic light pipe comprising at least one curve that is less than or equal to the maximum angle of deflection.

3. The toy of claim 1, wherein the maximum angle of deflection is about 41 degrees.

4. The toy of claim 1, the unitary thermoplastic light pipe being formed of PMMA.

5. The toy of claim 1, the unitary thermoplastic light pipe comprising two or more collector portions.

6. The toy of claim 5, the unitary thermoplastic light pipe comprising two or more output portions.

7. The toy of claim 1, wherein the unitary thermoplastic light pipe is only attached to the housing at one or both of the collector portion and the output portion.

8. The toy of claim 1, wherein the collector portion comprises a truncated conical shape.

9. The toy of claim 1, the collector portion provided in a portion of a base of the toy.

10. The toy of claim 1, the output portion mounted in one or more of a head, eyes, hands, clothing, and weapon of the toy.

11. The toy of claim 1, wherein the toy does not comprise a light source.

12. The toy of claim 1, wherein the surface area of the collector portion is between two times and ten times the surface area of the output portion.

13. The toy of claim 12, wherein the surface area of the collector portion is approximately 7.5 times the surface area of the output portion.

14. The toy of claim 1, wherein the unitary thermoplastic light pipe provides a maximum angle of deflection of approximately 44 degrees.

15. The toy of claim 1, wherein the unitary thermoplastic light pipe provides a maximum angle of deflection of approximately 35-41 degrees.

16. The toy of claim 15, wherein the unitary thermoplastic light pipe provides a maximum angle of deflection of approximately 35 degrees.

17. A toy system, comprising:

a mount;

a light source, the light source not comprised within the mount; and a toy comprising:

a base sized to support the toy on the mount, a housing comprising a first exterior surface, a second exterior surface, and a feature at the second exterior surface, and a light pipe mounted to the housing and comprising:

a collector portion proximate a first exterior surface of the housing, a transmitter portion, and an output portion proximate the feature of the housing, the light pipe configured to transmit light from the light source to the output portion, illuminating the feature of the housing.

18. The toy system of claim 17, the light pipe comprising at least one curve that is less than or equal to a maximum angle of deflection, wherein the maximum angle of deflection is about 35-45 degrees.

19. The toy system of claim 17, the mount comprising a predetermined placement area for the base of the toy, wherein the light source is configured to illuminate a portion of the base of the toy when the base of the toy is located in the placement area of the mount.

20. The toy system of claim 19, the mount comprising two or more predetermined placement areas corresponding to two or more toys comprising different features.

21. The toy system of claim 17, wherein the mount comprises an elevated platform configured to allow ambient light to reach the base of the toy when the toy is on the elevated platform, wherein the light pipe is configured to transmit the ambient light from the base of the toy to the output portion of the light pipe.

22. The toy system of claim 17, wherein the light source comprises a display of an electronic device, the display configured to show:

an outline of a base of said toy defining a placement area, an illumination area corresponding to a collector portion of the light pipe, and an activation button.

23. The toy system of claim 17, further comprising an electronic device comprising the mount and the light source.

24. The toy system of claim 17, the toy comprising two or more toys, the light source configured to output a different color light to each of the two or more toys.

25. The toy system of claim 17, further comprising:

the toy comprising a first toy and a second toy comprising different features;

the mount comprising a first placement area corresponding to the base of the first toy and a second placement area of the second toy; and the light source comprising a first light source corresponding to the first placement area of the mount and a second light source corresponding to the second placement area of the mount, wherein the first light source is configured to illuminate the collector portion of the light pipe at the base of the first toy and to not illuminate a collector portion of a light pipe at a base of the second toy, and wherein the second light source is configured to illuminate the collector portion at the base of the second toy and to not illuminate the collector portion at the base of the first toy.

26. The toy system of claim 17, wherein a surface area of the collector portion is between two times and ten times a surface area of the output portion.

27. The toy system of claim 26, wherein the surface area of the collector portion is approximately 7.5 times the surface area of the output portion.

28. The toy system of claim 17, wherein the unitary thermoplastic light pipe provides a maximum angle of deflection of approximately 44 degrees.

29. The toy system of claim 17, wherein the unitary thermoplastic light pipe provides a maximum angle of deflection of approximately 35-41 degrees.

30. The toy system of claim 29, wherein the unitary thermoplastic light pipe provides a maximum angle of deflection of approximately 35 degrees.

* * * * *